US005628047A

United States Patent [19]

Hiroyoshi

[11] Patent Number: 5,628,047

[45] Date of Patent: May 6, 1997

[54] METHOD OF MANUFACTURING A RADIALLY ORIENTED MAGNET

[75] Inventor: Hidetoshi Hiroyoshi, Sendai, Japan

[73] Assignee: Seiko Instruments Inc., Japan

[21] Appl. No.: 209,637

[22] Filed: Mar. 10, 1994

[30] Foreign Application Priority Data

Mar. 12, 1993 [JP] Japan ..... 5-052473

[51] Int. Cl.[6] ..... B22F 3/02

[52] U.S. Cl. ..... 419/62; 419/66; 29/607; 505/924

[58] Field of Search ..... 419/62, 66; 29/607; 505/924

[56] References Cited

U.S. PATENT DOCUMENTS

| | | | |
|---|---|---|---|
| 4,592,889 | 6/1986 | Leupold et al. | 419/66 |
| 4,600,555 | 7/1986 | Shimizu | 419/5 |
| 4,678,634 | 7/1987 | Tawara et al. | 419/30 |
| 4,954,800 | 9/1990 | Ohtsuka | 335/284 |
| 4,990,306 | 2/1991 | Ohashi | 419/28 |
| 5,004,580 | 4/1991 | Matsuo et al. | 419/65 |
| 5,041,419 | 8/1991 | Leupold | 505/1 |
| 5,167,915 | 12/1992 | Yamashita et al. | 419/12 |
| 5,250,255 | 10/1993 | Sagawa et al. | 419/39 |
| 5,338,372 | 8/1994 | Tabaru | 148/103 |

*Primary Examiner*—Charles T. Jordan
*Assistant Examiner*—Daniel Jenkins
*Attorney, Agent, or Firm*—Adams & Wilks

[57] ABSTRACT

A method of manufacturing a radially oriented magnet comprises disposing magnetic particles in a mold comprised of an insulating material, applying a pulsed magnetic field to the magnetic particles using a pair of pulse coils to impart a radial direction of magnetization to the magnetic particles, and press-forming the magnetic particles. The effective amount of magnetic flux which is applied to the magnetic particles can be effectively increased by introducing a pair of conducting rings between the pair of pulse coils for generating an eddy current effect between the pair of pulse coils to control the magnetic flux of the pulsed magnetic field. Such a method enables the manufacture of a downsized radially oriented magnet having a high degree of orientation.

18 Claims, 5 Drawing Sheets

METHOD OF MANUFACTURING A RADIALLY ORIENTED MAGNET

BACKGROUND OF THE INVENTION

1. Field of the Invention

The present invention relates to a method of manufacturing a radially oriented magnet, and more particularly to a method of manufacturing a radially oriented magnet for use in a small-sized motor or the like.

2. Description of the Prior Art

A radially oriented magnet is directed to) a ring-shaped magnet which has been manufactured by sintering or curing magnetic powders after they have been radially oriented (radial orientation). FIG. 3 shows a conventional method of manufacturing a radially oriented magnet. A mold structure as shown is provided with a magnetic yoke 11 formed of an electromagnet. The magnetic flux by the electromagnet 11 is induced in a magnetic circuit 12 as broken lines. Magnetic powder which is filled in the hole between a pair of upper and lower punches 13, 13*a* of a non-magnetic metallic yoke and is radially oriented by the magnetic circuit as shown in the figure, and then compressed in a ring shape by the upper punch 13.

Thus, the magnetic flux is induced in the magnetic circuit with the magnetic yoke and the magnetic powder oriented in radial directions in the magnetic circuit, and then the magnetic powder is press-formed in the magnetic field, thereby producing the conventional radial oriented magnet. In many cases, a steady magnetic field generated by an electromagnet is utilized, however, there is also a method of utilizing a pulse magnetic field.

Particularly, in the case where the yoke formed of a magnetic material inserted inside of the ring to form a magnetic circuit, the yoke material is liable to be saturated more as the cross sectional area of the yoke is reduced. Therefore, a magnetic field for the radial orientation of the magnetic powder is insufficient enough (for example, refer to Japanese Patent Unexamined Publication No.. Hei 2-281721, Japanese Patent Unexamined Publication No.. Hei 2-18905, Japanese Patent Unexamined Publication No.. Sho 63-310356, and the like), and therefore there is a drawback that a radial oriented magnet having a desired characteristic cannot be manufactured.

Further, in the case of using a pulse magnetic field, because a magnetic material and a non-magnetic material such as the punches, the die and the like are arranged at such positions that the magnetic flux is changed in a pulse manner, the magnetic field cannot be satisfactorily inserted into the magnetic material due to a skin effect of eddy current, and the magnetic field does not have a radial orientation, resulting in a drawback that the degree of orientation is extremely lowered.

The present invention has been made in view of the above-mentioned problems, and an object of the invention is to provide a method of manufacturing a radially oriented magnet which is downsized and has a high degree of orientation.

SUMMARY OF THE INVENTION

In order to solve the above-mentioned problems, the present invention provides a method of manufacturing a radially oriented magnet, comprising the steps of: forming a repulsive pulse magnetic field by a pair of coils, radially orienting a magnetic powder in the repulsive pulse magnetic field, and press-forming the magnetic powder which is radially oriented by use of insulator die materials.

To obtain a radially oriented magnet having a high degree of orientation, it is desirable to limit the effective inner diameter of the pulse coils to less than the outer diameter of the die punch +6 mm.

In accordance with a preferred embodiment of the present invention, a pair of electrically conductive rings are interposed between the pair of pulse Coils so as to control a flow of lines of magnetic flux due to an eddy current effect. Further, the above-mentioned electrically conductive rings are made of copper, aluminum, and preferably made of a superconducting material.

In the method of manufacturing the radially oriented magnet according to the invention., a pair of repulsive magnetic field pulse coils are used without any use of a yoke material. Therefore, the above-mentioned drawback resulting saturation of the yoke is solved, thereby enabling the radial oriented magnet to be downsized.

Further, in the method of manufacturing the radially oriented magnet according to the invention, the magnetic powder is radially oriented in a pulse magnetic field at a position or in the vicinity of lines of magnetic flux which have been formed radially, and then press-formed. Moreover, since a die, a punch, a core and the other parts disposed around the coils, which are die press materials, consist of insulators, even if a pulse magnetic field having a short time change of the magnetic flux is used, a flow of the magnetic flux in the pulse magnetic field is not affected by an eddy current effect and the like. Therefore, the magnetic powders to be oriented are satisfactorily radially oriented to obtain a desired intensity of magnetic flux.

DETAILED DESCRIPTION OF THE PREFERRED EMBODIMENTS

Embodiments of the present invention will be explained with reference to the following figures.

A magnet used in this embodiment is made from a 2-17 type SmCo rare-earth magnet raw material containing Fe, Cu and Zr. The raw material powder of the magnet which have been ground into super-fine powder of 3 μm by a jet mill is press-formed in a uniaxial magnetic field at approximately 12 kOe magnetic field, and then subjected to a usual heat treatment for the 2-17 type SmCo magnet, resulting in a sintered magnet having a characteristic with a maximum energy product of 30 MGOe.

[EMBODIMENT 1]

Figure 1:
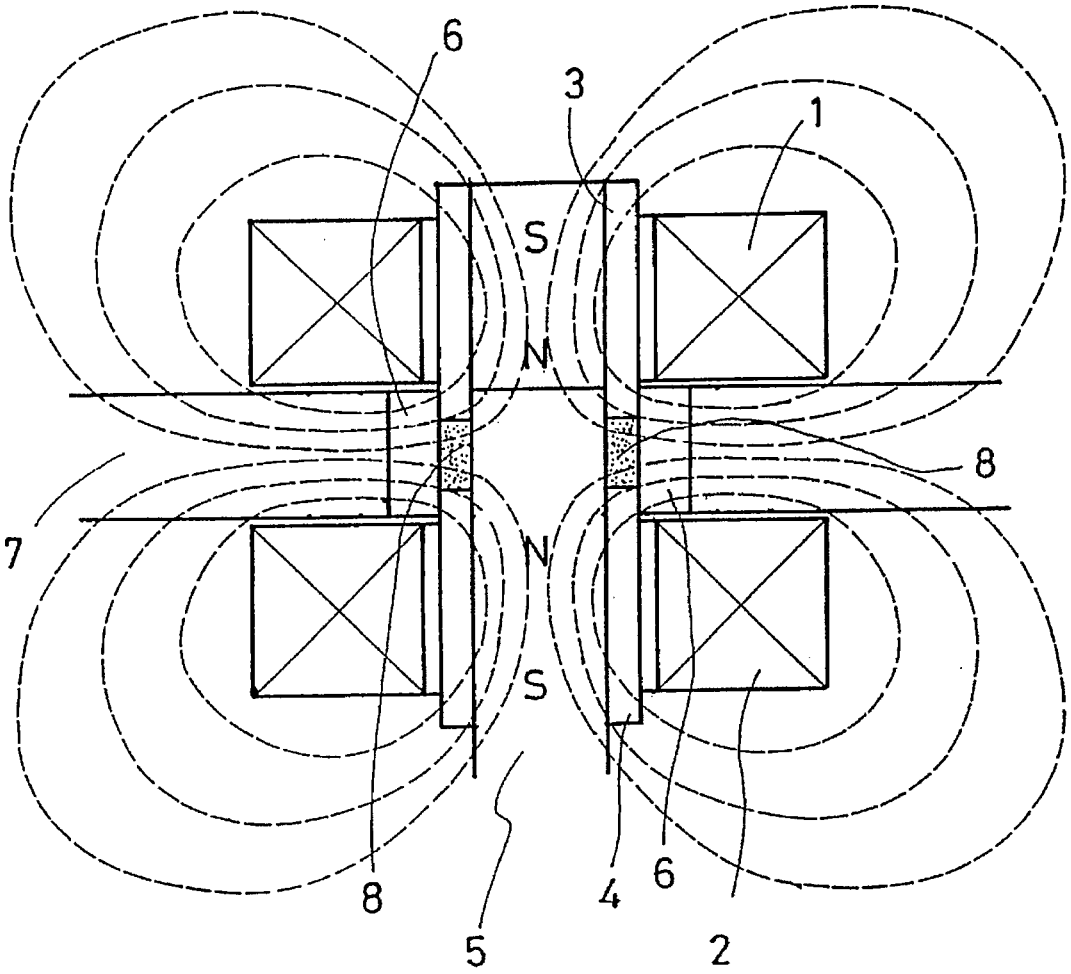
FIG. 1 is a cross-sectional view schematically showing an apparatus for practicing a method of manufacturing a radially oriented magnet according to the present invention.

FIG. 1 shows a schematical cross-sectional view of an apparatus for practicing a method of manufacturing a radially oriented magnet in accordance with the present invention. The structure of the apparatus in the figure includes a pair of solenoid coils 1 and 2. The solenoid coils 1 and 2 are connected in series to each other, and also connected to a pulse power source with 900 V and 12,000 μF. As shown in the figure, the direction of a pulse magnetic field of the pair solenoid coils 1 and 2 is repulsive to each other. Then, there are three coils a, b and c with following inner diameter and orientation ratio of magnets made by these coils are compared with each others.

The results are shown in table 1, where a: OD of punch +2 mm, b: OD of punch +6 mm, c: OD of punch +8 mm.

TABLE 1

| | ID: inner diameter OD: outer diameter | | |
|---|---|---|---|
| ID of coil | OD of magnet | orientation ratio | BHmax (MGOe) |
| a: | 18.6 mm | 95% | 25.5 |
| OD of punch + 2 mm | 14.0 | 93 | 23.0 |
| | 11.0 | 86 | 21.5 |
| b: | 18.6 mm | 92% | 24.0 |
| OD of punch + 6 mm | 14.0 | 91 | 21.5 |
| | 11.0 | 85 | 20.0 |
| c: | 18.6 mm | 80% | 17.5 |
| OD of punch + 8 mm | 14.0 | 76 | 16.0 |
| | 11.0 | 74 | 14.0 |

The apparatus includes a core 5 whose lower portion is fitted into a lower punch 4 and whose upper portion is fitted into an upper punch 3. The upper and lower punches 3 and 4 are able to move vertically by means of an oil press which is omitted from the figure. The upper and lower punches 3 and 4 are further fitted into a die 6. The die 6 is mechanically held by a die plate 7. The upper and lower punches 3, 4, the core 5, the die 6 and the die plate 7 define a mold for manufacturing the radially oriented magnet using a magnetic powder 8.

The upper punch 3, the lower punch 4, the core 5 and the 10, die 6 formed of non-magnetic insulating material and, for example, are made of ceramics with a high compression strength. The die plate 7 also formed of an insulating material (bake property).

Using the above-mentioned apparatus, a radially oriented magnet has been manufactured from magnetic powder in accordance with the present invention. First, the upper coil 1 and the upper punch 3 are moved upward from the die plate 7. Second the , magnetic particles or powder 8 is filled into a ring-shaped mold cavity which has been formed by the lower punch 4, the core 5 and the die 6. Subsequently, the upper coil 1 and the upper punch 3 are moved down and then stopped at a position where the magnetic powder 8 is not compressed by the upper punch 3. Thereafter, the magnetic powder 8 is moved in the annular space at the center of the die 6 so as to make a repulsive pulse magnetic field applied to the magnetic powder. After application of the repulsive pulse magnetic field, the magnetic powder is press-formed by the upper and lower punches 3 and 4.

It has been recognized that a higher degree of orientation could be obtained when the number of times of applying the magnetic field is two or three times. In general, when performing the formation in the magnetic field, the applied magnetic field is maintained during the press-forming process. However, in the method of the present invention, even though the magnetic field does not continue but disappears at the time of the pressurizing operation, there was no significant difference in the degree of orientation of the obtained magnet. This is because the die 6, the punches 3 and 4, and the core 5 are non-magnetic so that no residual field exists at all even though the magnetic field of a high intensity is applied thereto, whereby the magnetic powder is held in a state where it is radially oriented as it is, until the compression forming operation is completed.

In accordance with the manufacturing method of the present invention, using the above-mentioned apparatus, there have been manufactured a ring magnet having an outer diameter of 18.6 mm, an inner diameter of 15.4 mm and a thickness of 2.0 mm, and a ring magnet having an outer diameter of 14.0 mm, an inner diameter of 12.0 mm and a thickness of 1.5 mm using the a, b and c coils. Both of the ring magnets have been subjected to predetermined sintering and aging treatments. In order to investigate the degree of orientation of each ring magnet which has been finally manufactured, a cube of 1.5 mm square is taken from each of the ring magnets, thereby having obtained the residual magnetization Mx, My and Mz in the x, y and z directions thereof.

In the case that Mx corresponds to the direction of the radial orientation, the degree of orientation is represented by the following equation.

$$\textit{Orientation Degree (Ratio)}(\%)=100\times Mx/(\sqrt{(Mx^2+My^2+Mz^2)})$$

The orientation ratio and the maximum energy product BHmax are shown in Table 1.

From these; results the orientation ratio and BHmax are proportional to the OD of the magnets.

The relationship between the BHmax of the magnet made by three coils and the size of magnet indicate linear dependence as follows;

$$a:\ BHmax=[OD(mm)]\times 0.56+15$$

$$b:\ BHmax\ 32\ [OD(mm)]\times 0.54+14$$

$$c:\ BHmax=[OD(mm)]\times 0.58+8$$

From this result, the magnet made by coil c is inferior to the magnet made by coil a, b in magnetic properties and orientation ratio. Therefore, the magnet of the present invention has the BHmax=[OD(mm)]×0.6+12 or more.

Figure 3:
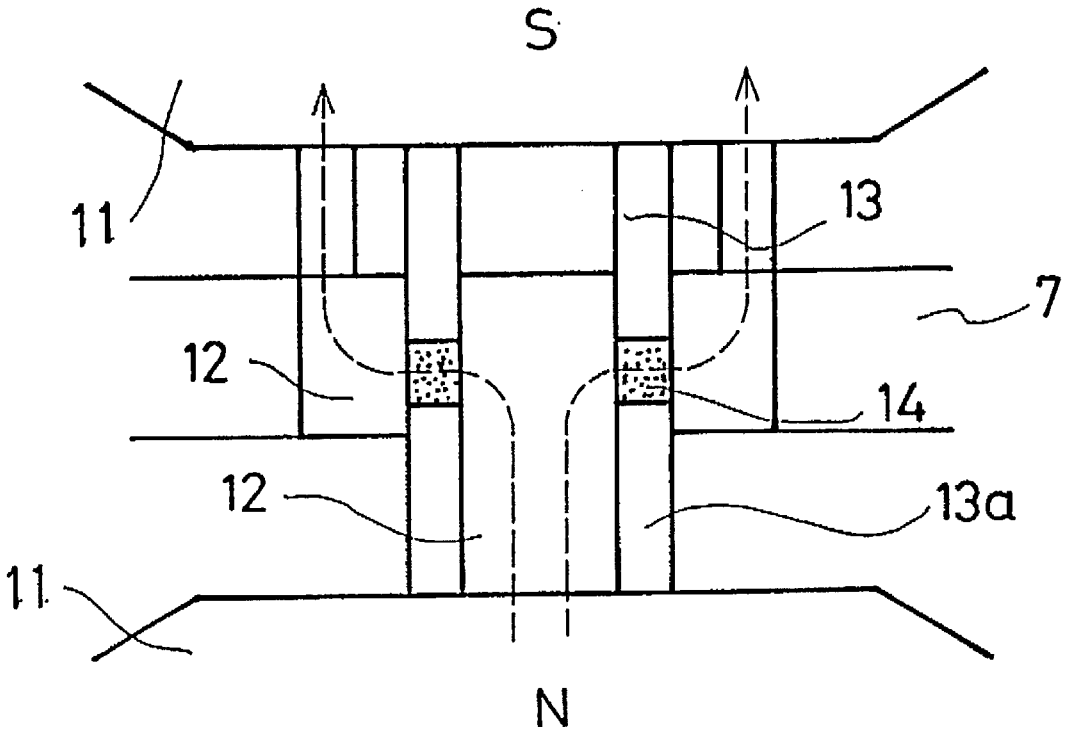
FIG. 3 is a diagram used for explaining a conventional method of manufacturing the radially oriented magnet.

Compared with this embodiment, using an NdFeB magnet raw material with BHmax of 35 MGOe higher than that of the SmCo magnet, there has been manufactured a radial oriented magnet having the same size as that of the ring magnet with the outer diameter of 18.6 mm by the conventional method using the yoke as shown in FIG. 3. The radial oriented magnet which has been manufactured by the conventional method had the degree of orientation of 85% and BHmax of 21 MGOe. Thus, it has been found that the method of the present invention can obtain a radial oriented magnet with a degree of orientation higher than, and a maximum energy product higher than those of the conventional method.

Figure 4A:
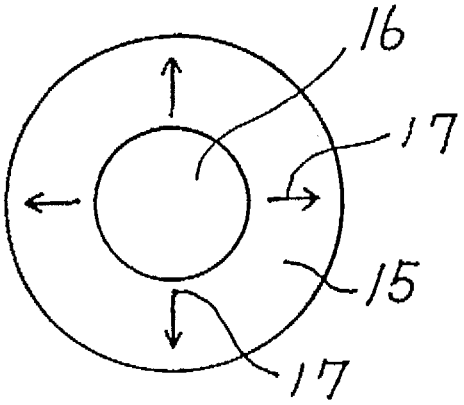
FIG. 4A and 4B shows an example of the radially oriented ring magnet of the present invention.
Figure 4B:
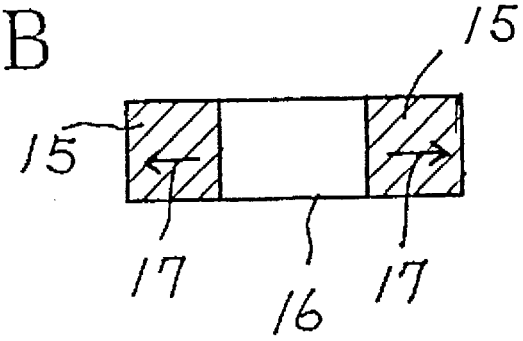

FIG. 4 shows an example of a radially oriented magnet manufactured by using the method of the present invention, where FIG. 4A shows a front view of the magnet 15, with a hole 16 and a direction of magnetization 17, and FIG. 4B shows a cross sectional view of the magnet 15.

Figure 5:
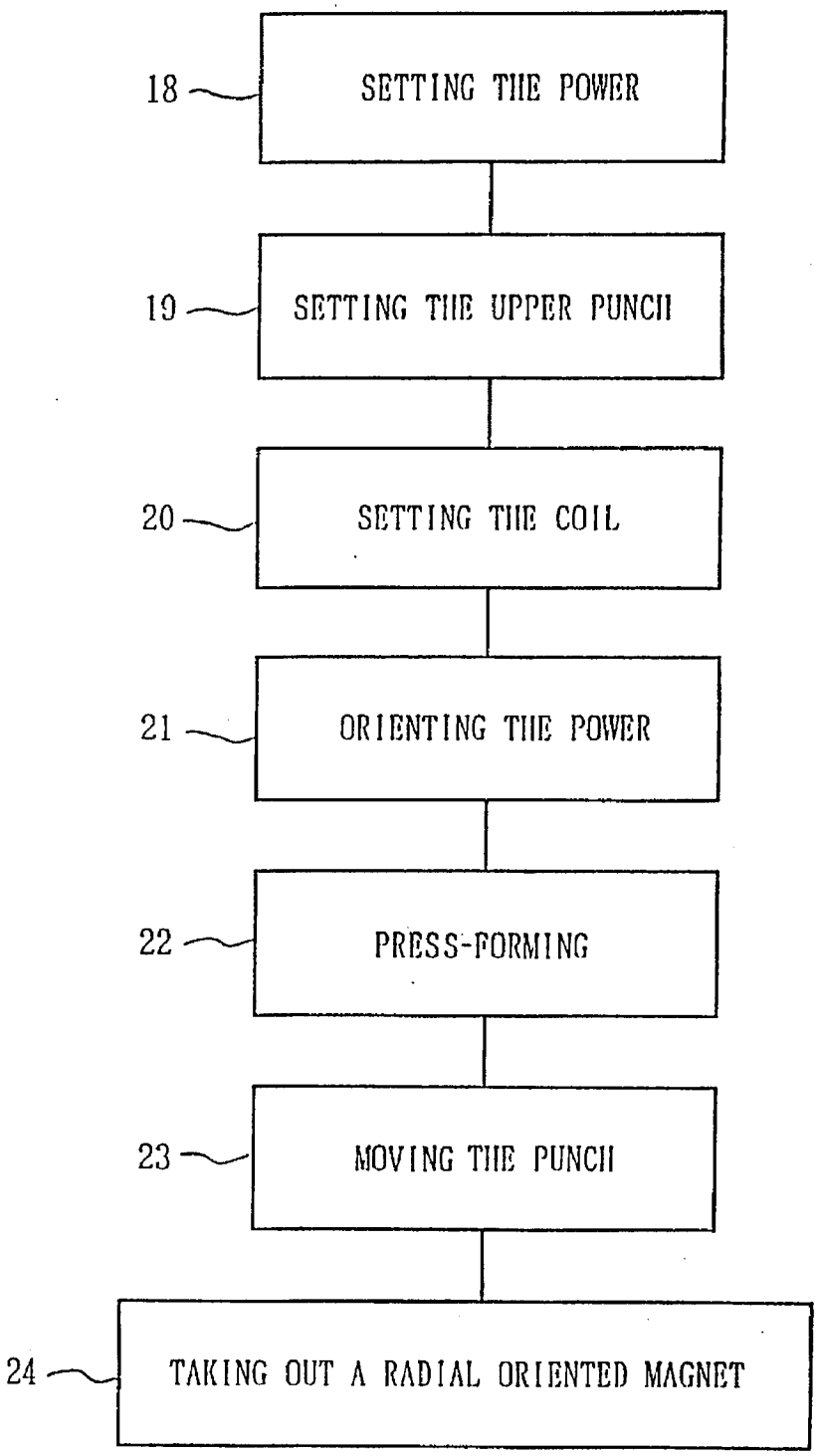
FIG. 5 shows the steps included in the method of the present invention.

FIG. 5 shows the steps used in a method of the embodiment of the present invention. Step 18 means setting the magnet powder into the mold, step 19 means setting the upper punch, step 20 means setting the coil, step 21 means radially orienting the powder, step 22 means press-forming of the magnet powder, step 23 means moving the upper punch and the lower punch, and step 24 means taking out the radially oriented ring magnet.

[EMBODIMENT 2]

Figure 2:
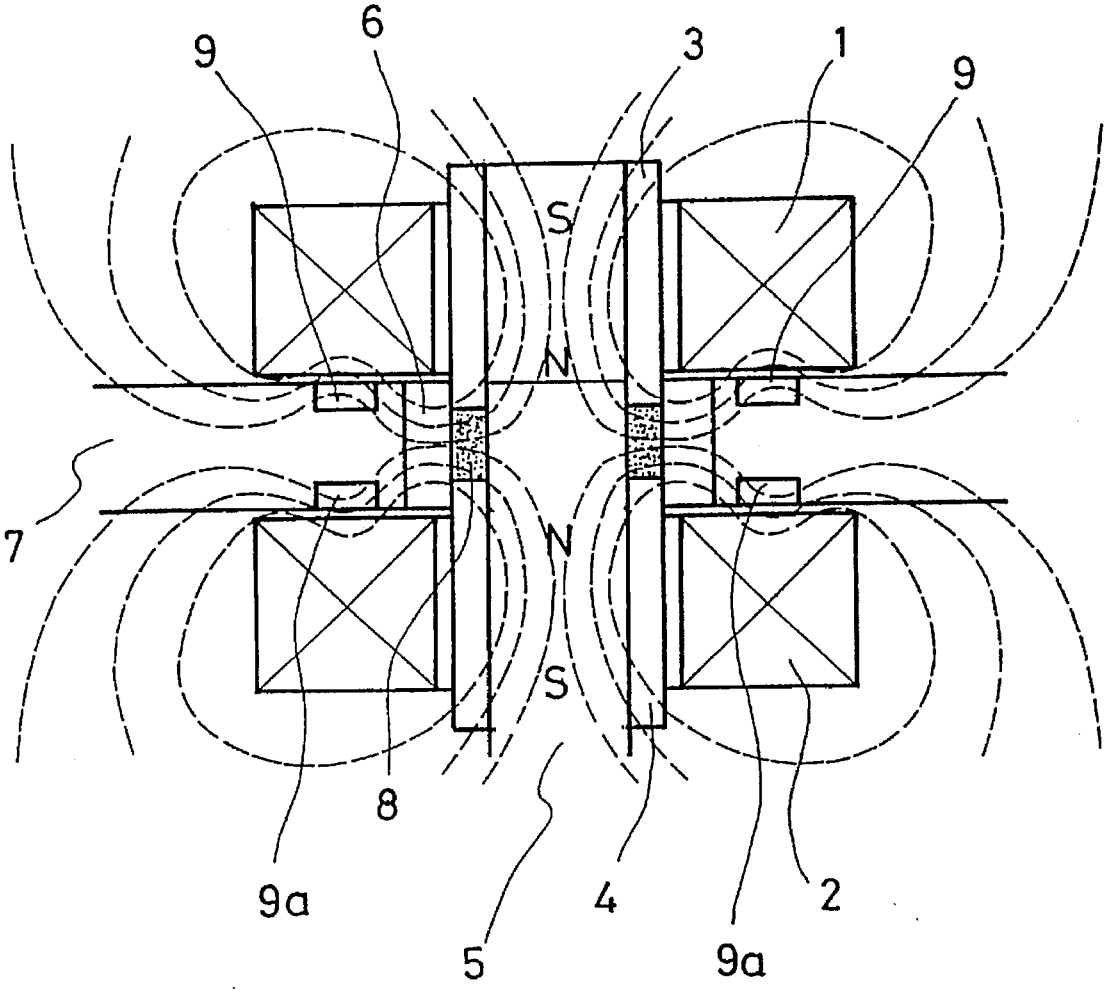
FIG. 2 is a cross-sectional view schematically showing another apparatus for practicing the method of manufacturing the radially oriented magnet according to the invention.

FIG. 2 is a cross-sectional view schematically showing another apparatus for practicing the method of manufacturing the radially oriented magnet according to the present invention. The basic difference of the apparatus in FIG. 2 from that of FIG. 1 is only that there is further provided an electrically conductive ring 9 and 9*a* which is made of a high conductive material, for example, copper, aluminum, etc., on the die 7 as shown in FIG. 2.

In the apparatus as shown, when a pulse field is applied by coils 1 and 2, an eddy current flows so as not to make the magnetic field penetrate into the .aluminum ring 9 and 9*a*. By this eddy current, a flow of magnetic flux due to the pulse coils 1 and 2 is controlled as shown by broken lines and increase the amount of flux with radial orientation ratio.

Using the above-mentioned apparatus, there has been manufactured a radially oriented magnet with the entirely same process as that, of the first embodiment. The ring magnet with the same size as that of the ring magnet having an outer diameter 18.6 mm of the first embodiment had the degree of orientation of 96% and BHmax of 26 MGOe. Thus, it has been recognized that, compared with the first embodiment without conductive ring 9, in the second embodiment providing the conductive ring 9, the magnetic flux in the radial direction was intensified at the position of the magnetic powder, and also the orientation ratio was increased.

In this embodiment, aluminum was used as an example for material of the electrically conductive ring. Since use of a superconducting material for the ring perfectly prevents the magnetic field from penetrating into the electrically conductive ring, it is apparent that the magnetic field in the radial direction is more intensified at the position of the magnetic powders, and the degree of orientation is further improved.

[EFFECT]

As was described above, in the method of manufacturing the radially oriented magnet in accordance with the present invention, since a yoke material is never used, such a drawback causing the saturation of the yoke is solved, thereby enabling the radially oriented magnet to be downsized. Furthermore, the magnetic powder is radially oriented at a position or in the vicinity of the lines of magnetic flux which have flown radially, and then press-formed into a ring magnet by use of the die, punch, core and the like which are formed of an insulating material. Therefore, even though a short time pulse magnetic field is used, a flow of magnetic flux in the pulse magnetic field is not affected by the eddy current effect and the like so that the magnetic powder to be oriented is satisfactorily radially oriented, thereby obtaining a desired intensity of the magnetic flux. Thus, the radially oriented magnet, which is downsized and of high characteristics, obtained by the method of manufacturing the radially oriented magnet according to the invention is expected to contribute to making the torque of more downsized spindle motors or the like higher.

What is claimed is:

1. A method of manufacturing a radially oriented magnet, comprising the steps of: disposing magnetic particles in a mold comprised of an insulating material; applying a pulsed magnetic field to the magnetic particles using a pair of pulse coils and without using a yoke member so as to impart a radial direction of magnetization to the magnetic particles; and press-forming the magnetic particles.

2. A method as claimed in claim 1; wherein the pair of pulse coils generates repulsive magnetic fields.

3. A method as claimed in claim 2; including the step of introducing a pair of conducting rings between the pair of pulse coils for generating an eddy current effect between the pair of pulse coils to control the magnetic flux of the pulsed magnetic field.

4. A method as claimed in claim 3; wherein the mold comprises a punch for compressing the magnetic particles during the press-forming step.

5. A method as claimed in claim 3; wherein the conducting rings are comprised of a superconducting material.

6. A method as claimed in claim 1; wherein the insulating material comprises ceramic.

7. A magnetic field as claimed in claim 1; wherein the pulsed magnetic field is not applied to the magnetic particles during the press-forming step.

8. A method as claimed in claim 7; wherein the applying step comprises applying the pulsed magnetic field to the magnetic particles at least two times prior to press-forming the magnetic particles.

9. A method of manufacturing a radially oriented magnet, comprising the steps of: preparing a mold comprising a core, a die and a pair of punch members defining a mold cavity; disposing magnetic particles in the mold cavity; applying a pulsed magnetic field to the magnetic particles so as to impart a radial direction of magnetization to the magnetic particles; and press-forming the magnetic particles using the pair of punch elements while the pulsed magnetic field is not being applied to the magnetic particles.

10. A method as claimed in claim 9; wherein the pulsed magnetic field is applied to the magnetic particles using a pair of pulse coils to generate repulsive magnetic fields.

11. A method as claimed in claim 10; including the step of introducing a pair of conducting rings between the pair of pulse coils for generating an eddy current effect between the pair of pulse coils to control the magnetic flux of the pulsed magnetic field.

12. A method as claimed in claim 10; wherein the conducting rings are comprised of a superconducting material.

13. A method as claimed in claim 9; wherein the core, the die and the pair of punch members are comprised of an insulating material.

14. A method as claimed in claim 13; wherein the insulating material comprises ceramic.

15. A method as claimed in claim 9; wherein the applying step comprises applying the pulsed magnetic field to the magnetic particles at least two times prior to press-forming the magnetic particles.

16. A method of manufacturing a radially oriented magnet, comprising the steps of: disposing magnetic particles in a mold; applying a pulsed magnetic field to the magnetic particles using a pair of pulse coils to impart a radial direction of magnetization to the magnetic particles; introducing a pair of conducting rings between the pair of pulse coils for generating an eddy current effect between the pair of pulse coils to control the magnetic flux of the pulsed magnetic field; and press-forming the magnetic particles.

17. A method as claimed in claim 16; wherein the conducting rings are comprised of a superconducting material.

18. A method as claimed in claim 17; wherein the superconducting material comprises one of aluminum and copper.

* * * * *